US011074892B1

(12) United States Patent
Peng

(10) Patent No.: US 11,074,892 B1
(45) Date of Patent: Jul. 27, 2021

(54) DETACHABLE VIOLONCELLO NON-SLIP PAD

(71) Applicant: Shenzhen Dedo Music Co., Ltd, Shenzhen (CN)

(72) Inventor: Qingyun Peng, Zhuzhou (CN)

(73) Assignee: SHENZHEN DEDO MUSIC CO., LTD, Shenzhen (CN)

( * ) Notice: Subject to any disclaimer, the term of this patent is extended or adjusted under 35 U.S.C. 154(b) by 0 days.

(21) Appl. No.: 17/033,794

(22) Filed: Sep. 27, 2020

(30) Foreign Application Priority Data

Aug. 5, 2020 (CN) ..... 202021615647.2

(51) Int. Cl.
*G10D 3/01* (2020.01)

(52) U.S. Cl.
CPC ..... *G10D 3/01* (2020.02)

(58) Field of Classification Search
CPC ..... G10D 3/00; G10D 3/18; G10D 3/01
See application file for complete search history.

(56) References Cited

U.S. PATENT DOCUMENTS 6,239,337 B1 * 5/2001 Stein ..... G10D 3/18 84/279

* cited by examiner

*Primary Examiner* — Kimberly R Lockett

(57) ABSTRACT

The present disclosure provides a detachable violoncello non-slip pad, which includes an non-slip portion and a limiting portion. The limiting portion is partially detachably received in the non-slip portion. The limiting portion includes a mounting plate and a limiting plate. The mounting plate is fixedly connected to the limiting plate. The mounting plate is detachably received in the non-slip portion. The detachable violoncello non-slip pad can separate the non-slip portion and the limiting portion, which is convenient for cleaning. When the non-slip portion is worn, only the non-slip portion needs to be replaced without overall replacement, which reduces the use cost of a user.

9 Claims, 5 Drawing Sheets

DETACHABLE VIOLONCELLO NON-SLIP PAD

CROSS REFERENCE TO RELATED APPLICATIONS

The present disclosure claims priority to Chinese Patent Application No. 202021615647.2, filed Aug. 5, 2020, which is hereby incorporated by reference herein as if set forth in its entirety.

BACKGROUND

1. Technical Field

The present disclosure relates to the field of musical instrument accessories, and particularly to a detachable violoncello non-slip pad.

2. Description of Related Art

The violoncello is placed on a violoncello non-slip pad when in use. Referring to FIG. 1, a conventional violoncello non-slip pad consists of a main body 1 and an non-slip rubber 2 disposed at a bottom of the main body 1. The main body 1 is further provided with a tether groove 4 and a placement hole 3. The non-slip rubber 2 can be worn after being used for many times, so that the non-slip rubber 2 is easy to slip. When in use, a supporting rod of the violoncello is placed in the placement hole 3. In order to prevent the non-slip rubber 2 from slipping to cause long-distance sliding of the supporting rod of the violoncello during use, the long-distance sliding of the supporting rod of the violoncello can cause the violoncello to fall down or even be damaged, the conventional violoncello non-slip pad needs to be tied on a table leg or a chair leg by extending a rope through the tether groove 4 during use, so that the sliding distance of the violoncello non-slip pad is limited. In summary, the conventional violoncello non-slip pad has the following disadvantages:

1. The non-slip rubber 2 is worn after being used for many times, resulting in a reduction in the friction force between the non-slip rubber 2 and the floor, so that the violoncello non-slip pad cannot be firmly mounted on the floor, the non-slip rubber 2 cannot be replaced separately, and only the violoncello non-slip pad can be replaced as a whole, which increases the use cost of a user.
2. Using the rope to limit the sliding distance of the violoncello non-slip pad is not only unaesthetic, but also has safety risks, and the rope can trip people.

BRIEF DESCRIPTION OF THE DRAWINGS

In order to more clearly illustrate the technical solutions in this embodiment disclosure, the drawings used in the embodiments or the description of the prior art will be briefly introduced below. It should be understood that, the drawings in the following description are only examples of the present disclosure. For those skilled in the art, other drawings can be obtained based on these drawings without creative works.

DETAILED DESCRIPTION

In order to make the objectives, technical solutions, and advantages of the present disclosure clearer, the present disclosure will be further described in detail below with reference to the drawings and embodiments. It should be understood that, the embodiments described herein are only for explaining the present disclosure and are not intended to limit the present disclosure.

Figure 1:
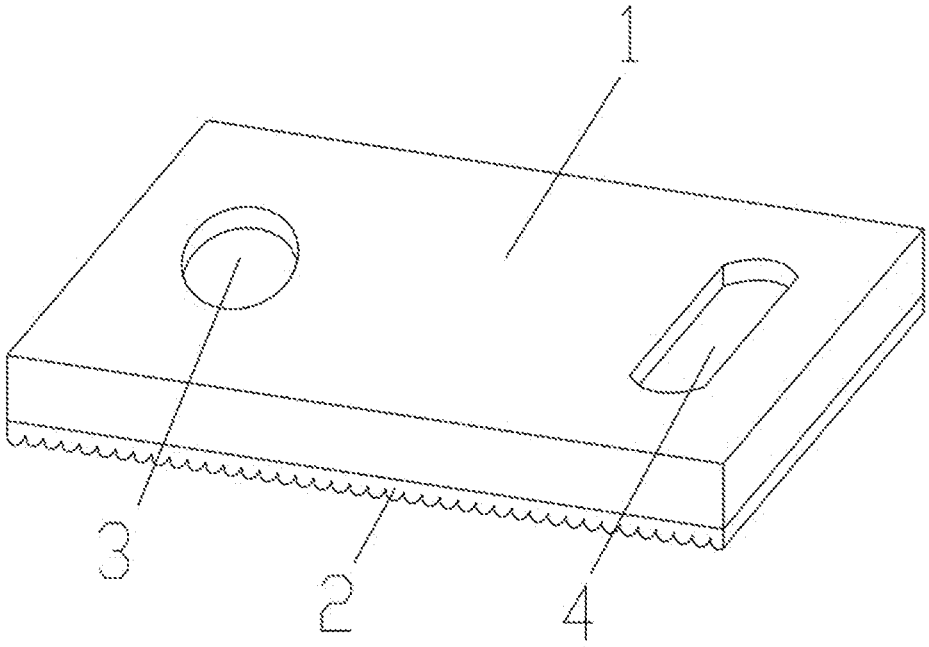
Prior Art FIG. 1
FIG. 1 is a perspective view of a conventional violoncello non-slip pad.
Figure 2:
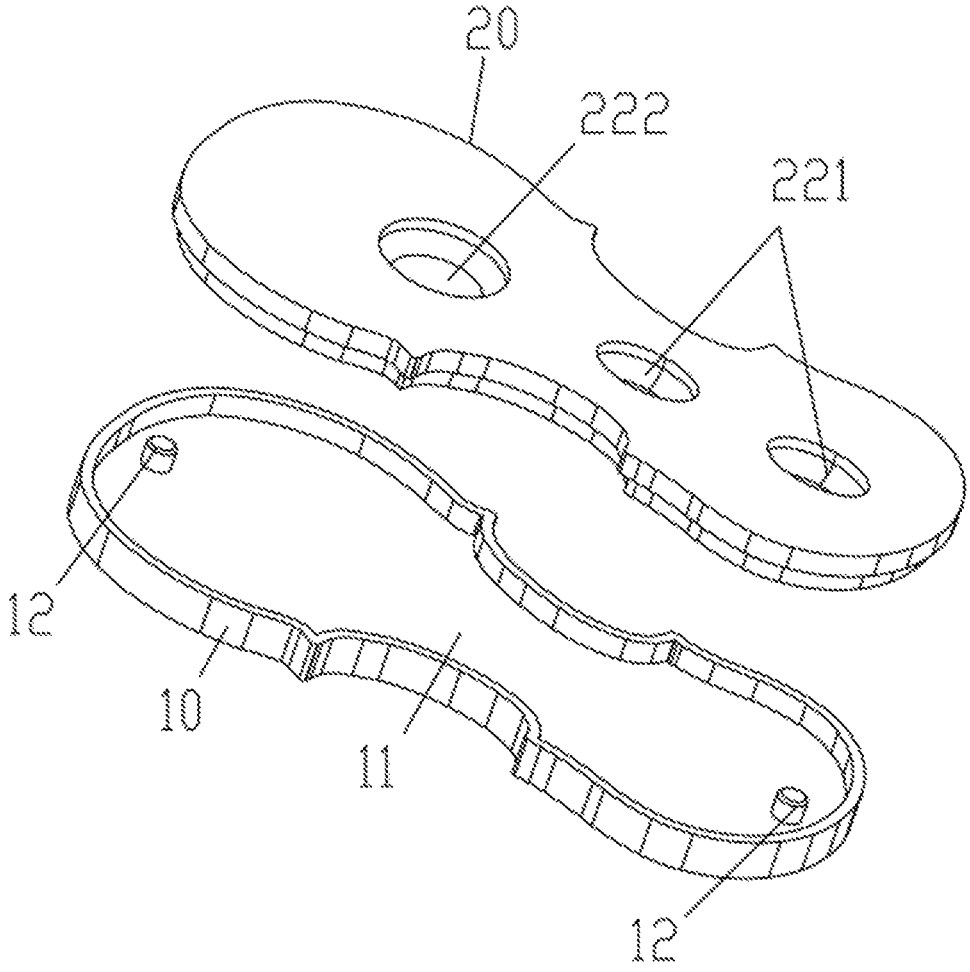
FIG. 2 is an exploded view of a detachable violoncello non-slip pad according to the present disclosure.
Figure 3:
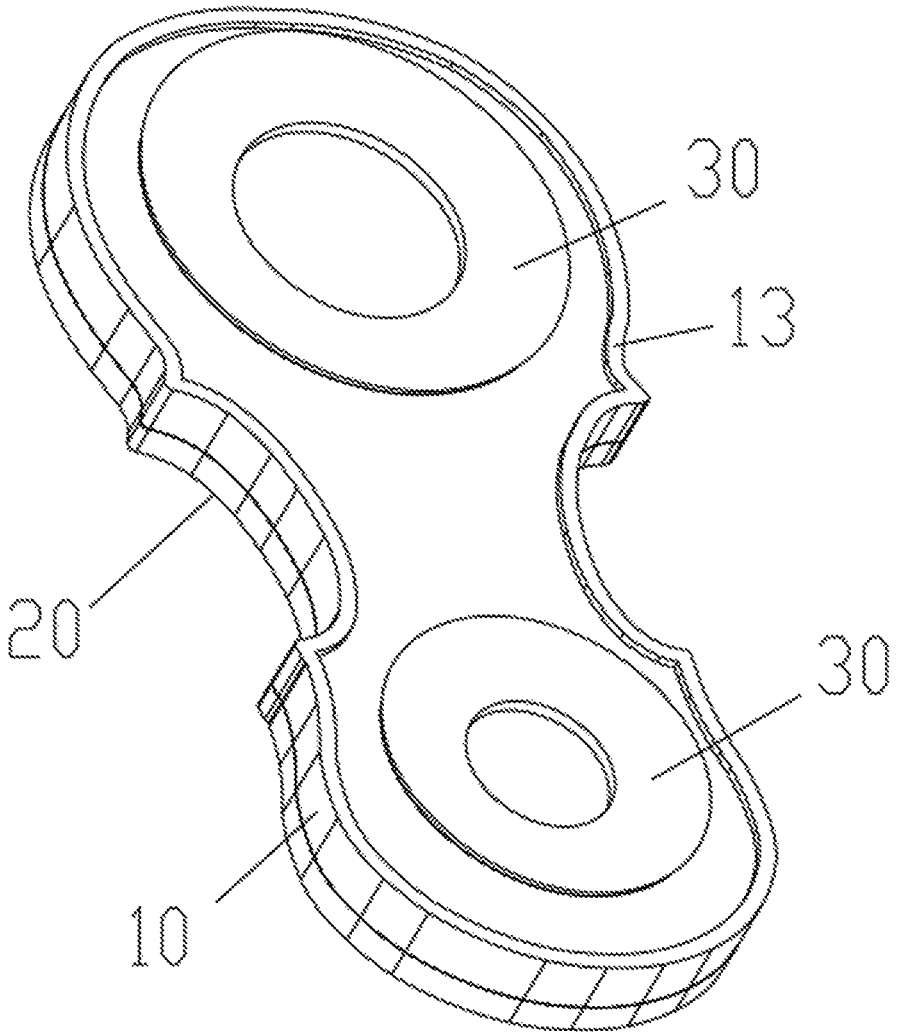
FIG. 3 is a perspective view of a detachable violoncello non-slip pad according to the present disclosure.
Figure 4:
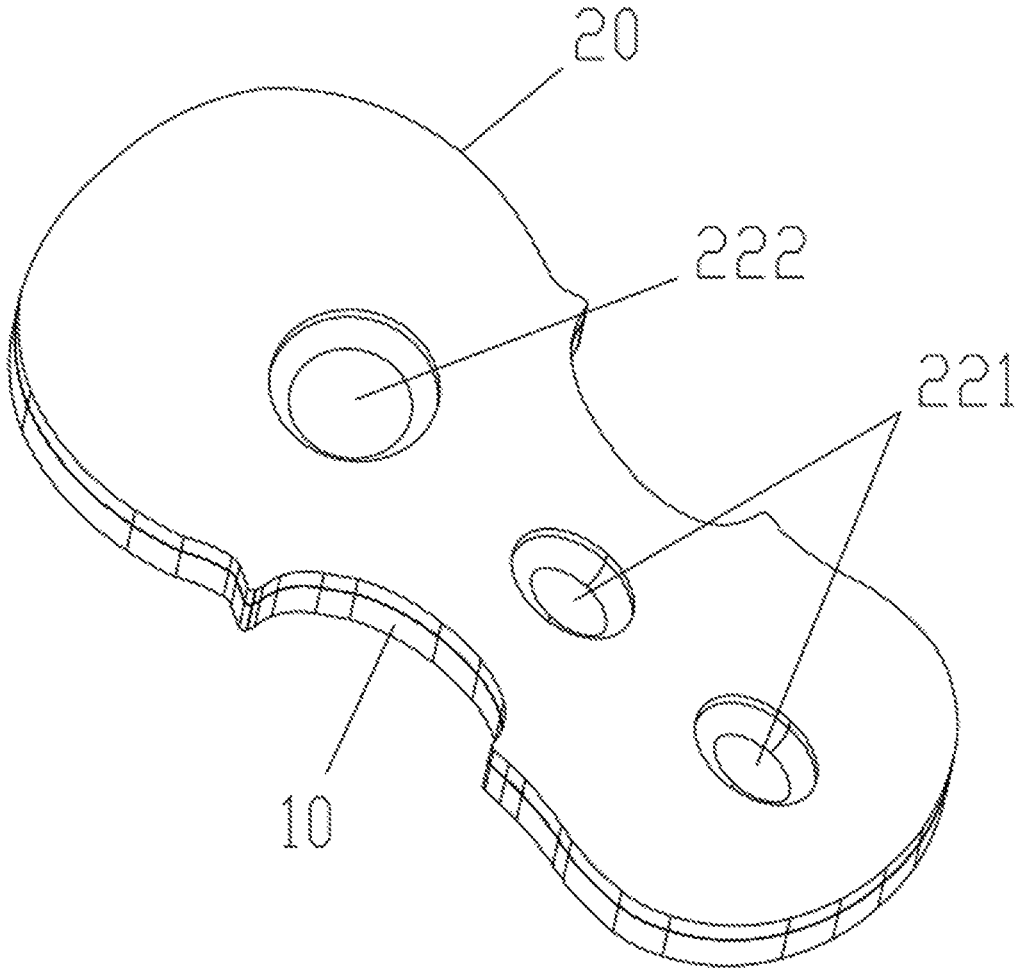
FIG. 4 is another perspective view of a detachable violoncello non-slip pad according to the present disclosure.
Figure 5:
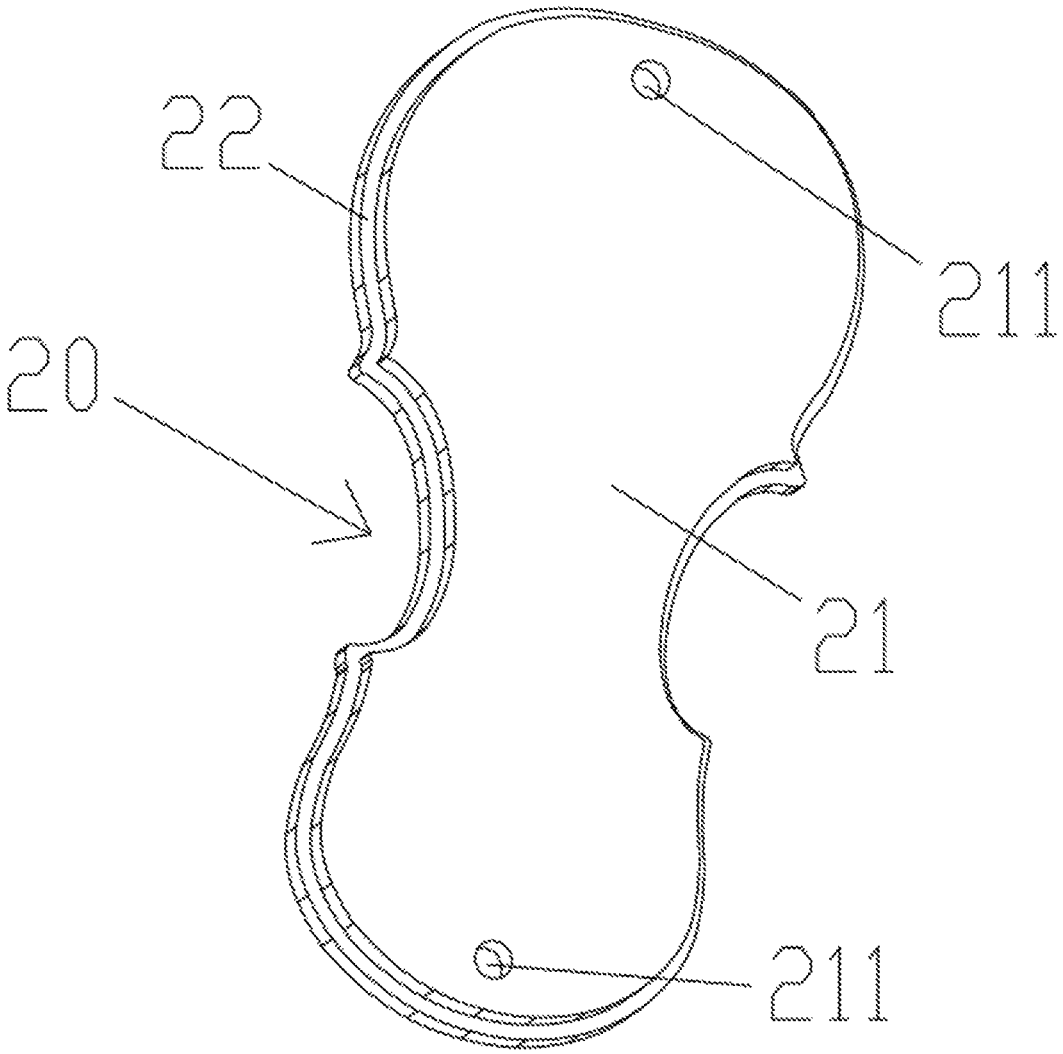
FIG. 5 is a perspective view of a limiting portion of a detachable violoncello non-slip pad according to the present disclosure.

Referring to FIGS. 2 to 5, the present disclosure provides a detachable violoncello non-slip pad, which includes an non-slip portion 10 and a limiting portion 20. The limiting portion 20 is partially detachably received in the non-slip portion 10. The limiting portion 20 includes a mounting plate 21 and a limiting plate 22. The mounting plate 21 is fixedly connected to the limiting plate 22, and the mounting plate 21 is detachably received in the non-slip portion 10. The mounting plate 21 is smaller than the limiting plate 22, and the limiting plate 22 abuts against the non-slip portion 10. The non-slip portion 10 is made of wear-resistant and non-slip rubber.

In the present embodiment, the mounting plate 21 is smaller than the limiting plate 22, and the mounting plate 21 does not completely cover the limiting plate 22. When the mounting plate 21 is received in the non-slip portion 10, the limiting plate 22 abuts against the non-slip portion 10, thereby facilitating the separation of the non-slip portion 10 from the limiting portion 20. When in use, since the non-slip portion 10 is made of wear-resistant and non-slip rubber, there is a large friction force between the non-slip portion 10 and the floor, and the detachable violoncello non-slip pad can be firmly mounted on the floor through the non-slip portion 10. If the non-slip portion 10 is worn out after being used for many times, only the non-slip portion 10 needs to be replaced without overall replacement, which reduce the use cost of a user.

In the present embodiment, if dust adheres to the non-slip portion 10 resulting in a reduction of the friction force between the non-slip portion 10 and the floor, the non-slip portion 10 and the limiting portion 20 can be detached from each other, thereby facilitating cleaning of the non-slip portion 10.

In addition, the detachable violoncello non-slip pad further includes at least one sucker 30. The sucker 30 is fixedly mounted at a bottom of the limiting portion 20, and protrudes from the limiting portion 20.

In the present embodiment, the number of the suckers 30 is two. The detachable violoncello non-slip pad can be firmly adsorbed on the floor through the suckers 30 for use, and even if the violoncello non-slip pad is used for a long time or used for many times, the suckers 30 can still be firmly adsorbed on the floor. The detachable violoncello non-slip pad is not required to be tied on a table leg or a chair leg through the rope when in use, which is not only aesthetically pleasing, but also has no safety risk of tripping people.

In the present embodiment, if dust adheres to the sucker 30, so that the suction force of the sucker 30 is weakened, the non-slip portion 10 and the limiting portion 20 can be detached from each other, thereby facilitating cleaning of the sucker 30.

Furthermore, the limiting plate 22 is provided with at least one first limiting hole 221 and at least one second limiting hole 222, and a shape of the first limiting hole 221 is different from that of the second limiting hole 222.

In the present embodiment, the number of the first limiting holes 221 is two, and the number of the second limiting hole 222 is one. The shape of the first limiting hole 221 is different from that of the second limiting hole 222, so that the detachable violoncello non-slip pad can be adapted to more supporting rods of a violoncello.

Furthermore, the non-slip portion 10 is provided with a mounting groove 11, the mounting plate 21 is matched with the mounting groove 11, and the mounting plate 21 is received in the mounting groove 11.

In the present embodiment, the mounting plate 21 is matched with the mounting groove 11. When the mounting plate 21 is received in the mounting groove 11, since the non-slip portion 10 is made of wear-resistant and non-slip rubber, the friction force between the non-slip portion 10 and the mounting plate 21 is very large, so that the limiting portion 20 and the non-slip portion 10 are firmly connected.

Furthermore, the non-slip portion 10 further includes a positioning post 12. The positioning post 12 is received in the mounting groove 11 and fixedly connected to the non-slip portion 10. The positioning post 12 extends into the mounting plate 21. The mounting plate 21 is provided with a positioning hole 211 matched with the positioning post 12, and the positioning post 12 is received in the positioning hole 211.

In the present embodiment, the positioning post 12 is made of is made of wear-resistant and non-slip rubber, and the positioning hole 211 is matched with the positioning post 12. When the mounting plate 21 is received in the mounting groove 11, the positioning post 12 is received in the positioning hole 211, and since the positioning post 12 is made of wear-resistant and non-slip rubber, the friction force between the positioning post 12 and the mounting plate 21 is very large, so that the limiting portion 20 and the non-slip portion 10 are firmly connected.

In the present embodiment, the mounting plate 21 can be accurately mounted in the mounting groove 11 through the cooperation of the positioning hole 211 and the positioning post 12.

Furthermore, the non-slip portion 10 is further provided with a barrier 13 on a periphery of a bottom thereof. The barrier 13 protrudes from the non-slip portion 10, and the sucker 30 is higher than the barrier 13.

In the present embodiment, the barrier 13 is made of wear-resistant and non-slip rubber. When in use, the detachable violoncello non-slip pad is firmly adsorbed on the floor through the sucker 30, and the supporting rod of a violoncello is placed in the first limiting hole 221 or the second limiting hole 222. At this time, the limiting portion 20 presses against the non-slip portion by the gravity of the violoncello, since the non-slip portion 10 is made of wear-resistant and non-slip rubber, the non-slip portion 10 is deformed causing the barrier 13 abutting against the floor. There is also friction force between the barrier 13 and the floor, the detachable violoncello non-slip pad can be firmly connected to the floor through the cooperatively action of the barrier 13 and the sucker 30, thereby ensuring that the detachable violoncello non-slip pad cannot slide relative to the floor during the use of the violoncello.

The above-mentioned embodiments are merely intended for describing but not for limiting the technical schemes of the present disclosure. Although the present disclosure is described in detail with reference to the above-mentioned embodiments, it should be understood by those skilled in the art that, the technical schemes in each of the above-mentioned embodiments may still be modified, or some of the technical features may be equivalently replaced, while these modifications or replacements do not make the essence of the corresponding technical schemes depart from the spirit and scope of the technical schemes of each of the embodiments of the present disclosure, and should be included within the scope of the present disclosure.

What is claimed is:

1. A detachable violoncello non-slip pad, comprising:

an non-slip portion, and a limiting portion partially detachably received in the non-slip portion, the limiting portion comprising a mounting plate and a limiting plate, the mounting plate fixedly connected to the limiting plate, the mounting plate detachably received in the non-slip portion.

2. The detachable violoncello non-slip pad according to claim 1, further comprising at least one sucker fixedly mounted at a bottom of the limiting portion, the sucker protrudes from the limiting portion.

3. The detachable violoncello non-slip pad according to claim 1, wherein the limiting plate is provided with at least one first limiting hole and at least one second limiting hole, and a shape of the first limiting hole is different from a shape of the second limiting hole.

4. The detachable violoncello non-slip pad according to claim 1, wherein the mounting plate is smaller than the limiting plate, and the limiting plate abuts against the non-slip portion.

5. The detachable violoncello non-slip pad according to claim 1, wherein the non-slip portion is provided with a mounting groove, the mounting plate is matched with the mounting groove, and the mounting plate is received in the mounting groove.

6. The detachable violoncello non-slip pad according to claim 5, wherein the non-slip portion further comprises a positioning post received in the mounting groove and fixedly connected to the non-slip portion, and the positioning post extends into the mounting plate.

7. The detachable violoncello non-slip pad according to claim 6, wherein the mounting plate is provided with a positioning hole matched with the positioning post, and the positioning post is received in the positioning hole.

8. The detachable violoncello non-slip pad according to claim 2, wherein the non-slip portion is further provided with a barrier on a periphery of a bottom thereof, the barrier protrudes from the non-slip portion, and the sucker is higher than the barrier.

9. The detachable violoncello non-slip pad according to claim 1, wherein the non-slip portion is made of wear-resistant and non-slip rubber.

* * * * *